US007052291B2

(12) United States Patent
Barina et al.

(10) Patent No.: US 7,052,291 B2
(45) Date of Patent: May 30, 2006

(54) BOARD CONNECTOR ADJUSTING SYSTEM

(75) Inventors: Richard Barina, Wellington, FL (US); Dean F. Herring, Youngsville, NC (US); Glenn E. Myrto, Holly Springs, NC (US)

(73) Assignee: International Business Machines Corporation, Armonk, NY (US)

( * ) Notice: Subject to any disclaimer, the term of this patent is extended or adjusted under 35 U.S.C. 154(b) by 116 days.

(21) Appl. No.: 10/730,970

(22) Filed: Dec. 9, 2003

(65) Prior Publication Data

US 2005/0124204 A1 Jun. 9, 2005

(51) Int. Cl.
*H01R 13/648* (2006.01)

(52) U.S. Cl. ..... 439/92; 361/758

(58) Field of Classification Search ..... 439/95, 439/92, 74; 361/758, 759; 174/35 R
See application file for complete search history.

(56) References Cited

U.S. PATENT DOCUMENTS 4,938,703 A * 7/1990 Nakano ..... 439/74
5,218,760 A * 6/1993 Colton et al. ..... 29/845
5,727,761 A * 3/1998 Ho ..... 248/222.12
6,424,538 B1 * 7/2002 Paquin ..... 361/752

* cited by examiner

*Primary Examiner*—Phuong Dinh
(74) *Attorney, Agent, or Firm*—Martin J. McKinley; Dillon & Yudell LLP

(57) ABSTRACT

A system permitting vertical and horizontal movement of a first board for proper mating of a first connector on the first board to a second connector on a second board. The first board being aligned pivots about a pivot pin, which is mounted on a mechanical plate at a first end of the board that is opposite to a second end of the board to which a first connector is mounted. This pivoting allows transverse (horizontal) movement of the first board. The first board floats on springs located between the first board and the mechanical plate to which the first board is mounted. These springs afford longitudinal (vertical) movement of the first board, while also providing a friction fit between the first board and the mechanical plate. When the first connector is aligned properly with as second connector on a second board, the first and second connectors can be mated.

8 Claims, 5 Drawing Sheets

BOARD CONNECTOR ADJUSTING SYSTEM

BACKGROUND OF THE INVENTION

1. Technical Field

This invention relates generally to computer manufacturing, and in particular to board alignment. Still more particularly, the present invention relates to a board connector adjusting system that allows fine alignment of connectors mounted on different computer boards on different mechanical plates.

2. Description of the Related Art

A typical computer architecture calls for multiple printed circuit boards (boards) to be interrelated and interconnected. Each board contains printed electrical circuits that connect various components of the board, including but not limited to components such as a processor, a memory, custom logic, and Input/Output (I/O) circuitry. The I/O circuitry often terminates in a connector, such as a Universal Serial Bus (USB) port, a Personal Computer Memory Card International Association (PCMCIA) connector, an IEEE 1284 parallel connector, or other type of connector known to those skilled in the art. In addition, the I/O circuitry or other circuitry in the board may terminate in an internal type connector, which electrically interconnects two boards that are on the same or different mechanical plates.

In most cases, the orientation of the internal connectors is critical, since misaligned connectors will lead to connections between male plugs and female ports that either become stuck or else are impossible to couple.

To align a first connector mounted on a first board to a second connector mounted on a second board, a manufacturer of the computer having the first and second boards must take steps to ensure that the boards and connectors are properly aligned for proper connection. Typically, the first board is mounted to a fixed first mechanical plate (a planar board that does not include logic, but rather serves primarily as a fixed platform on which to mount the board), and the second board is mounted on a movable second mechanical plate.

If the first mechanical plate is mounted with two planar boards, and the second mechanical plate is mounted with two other planar boards, then alignment between each pair of boards becomes increasing difficult. That is, assume that the first mechanical plate has two rigidly mounted planar boards, each having a connector at one end. Then assume that the second mechanical plate likewise has two rigidly mounted planar boards, each also having a connector at one end. One pair of connectors (one from a planar board on the first mechanical plate and one from a planar board on the second mechanical plate) can easily be aligned for proper connection. However, the connectors on the remaining two planar boards on each of the mechanical plates are rarely properly aligned.

Thus, there is a need for a method and system that allows a manufacturer of a computer to align a first board that is mounted to a fixed first mechanical plate with a second board mounted on a moveable second mechanical plate, thus permitting an alignment of connectors that are mounted on the two boards for a proper connection between the connectors.

SUMMARY OF THE INVENTION

As will be seen, the foregoing invention satisfies the foregoing needs and accomplishes additional objectives. Briefly described, the present invention provides a system that permits vertical and horizontal movement of a first board to allow proper mating of a first connector on the first board to a second connector on a second board.

The first board being aligned pivots about a pivot pin, which is mounted on a mechanical plate at a first end of the board that is opposite to a second end of the board to which a first connector is mounted. This pivoting allows transverse (horizontal) movement of the first board. The first board floats on springs located between the first board and the mechanical plate to which the first board is mounted. These springs afford longitudinal (vertical) movement of the first board, while also providing a friction fit between the first board and the mechanical plate. When the first connector is aligned properly with as second connector on a second board, the first and second connectors can be mated.

BRIEF DESCRIPTION OF THE DRAWINGS

The novel features believed characteristic of the invention are set forth in the appended claims. The invention itself, however, as well as the preferred modes of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1A:
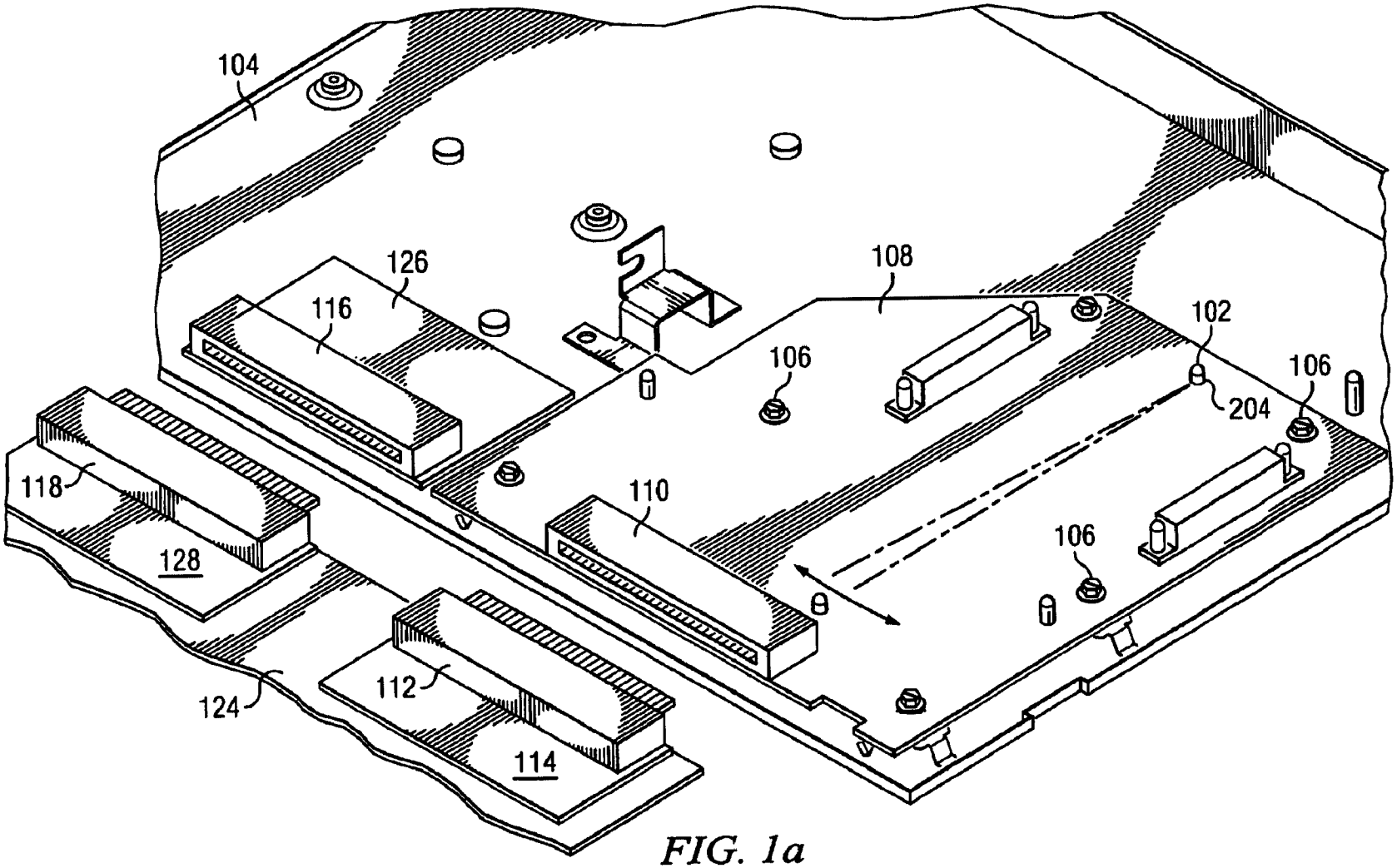
FIG. 1*a* depicts a first planar board mounted to a first mechanical plate, and a second planar board mounted to a second mechanical plate, such that the first and second mechanical plates are co-planar and each board has an end connector.

Referring now to the drawing figures, in which like numerals indicate like elements or steps throughout the several views, the preferred embodiment of the present invention will be described. In general, the present invention provides an improved method and apparatus for allowing restrained limit movement of a first planar board to allow proper special orientation relative to a second planar board, thus allowing connectors on the two boards to align for proper mating.

With reference now to FIG. 1*a*, there is depicted a first planar board 108 loosely mounted to a first mechanical plate 104. Oriented co-planar to first mechanical plate 104 is a second planar board 114, which is mounted to a second mechanical plate 124. Mounted on first planar board 108 is a first connector 110, and mounted to second planar board 114 is a second connector 112. In a preferred embodiment, first connector 110 and second connector 112 provide electrical and logical communication between first planar board 108 and second planar board 114.

Also shown in FIG. 1*a* is a third planar board 126, which has a third connector 116, mounted on first mechanical plate 104. Also mounted on second mechanical plate 124 is a fourth planar board 128, which has a fourth connector 118. Third connector 116 and fourth connector 118 are designed to connect to each other, in a manner and purpose analogous to that described for first connector 110 and second connector 112 to provide electrical communication between third planar board 126 and fourth planar board 128. Third connector 116 and fourth connector 118 can be physically aligned to provide a proper mating between them. However, such an alignment may or may not align first connector 110 with second connector 112, a problem that the present invention addresses.

Figure 1B:
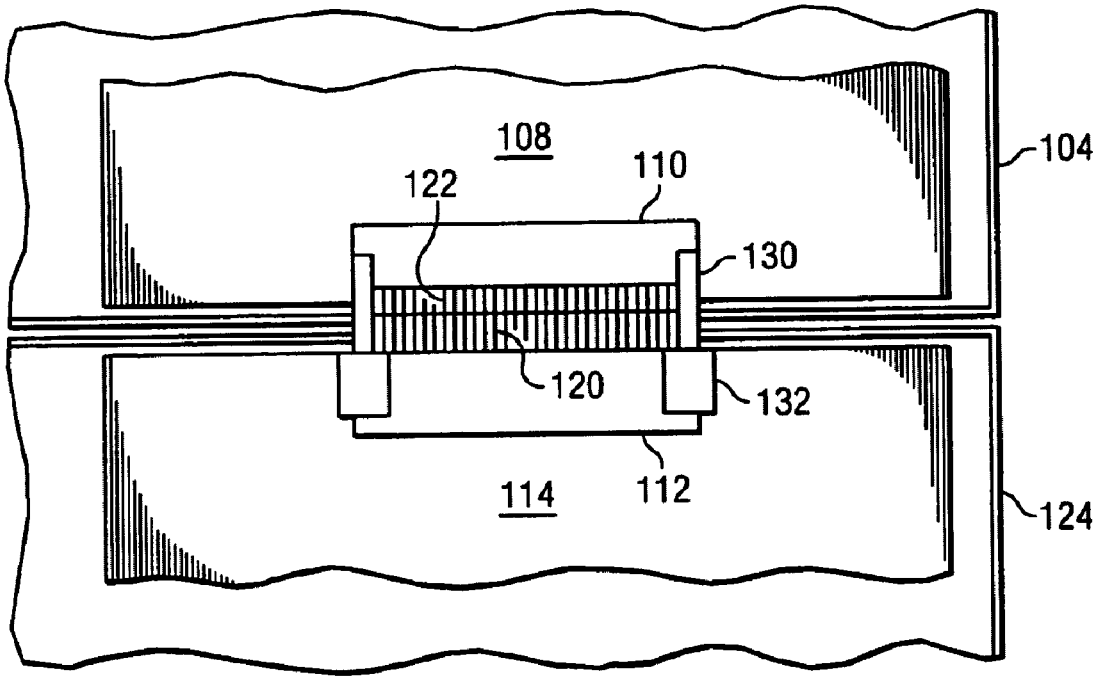
FIG. 1*b* illustrates a top view of the two connectors, shown in FIG. 1*a*, now mated.

In the exemplary illustration of FIG. 1*a*, each of pair of connectors (first connector 110 and second connector 112; third connector 116 and fourth connector 118) are roughly co-planar. Each pair, such as first connector 110 and second connector 112, achieves fine alignment by the mating of alignment pins 130 with alignment channels 132, as shown in FIG. 1*b*. Third connector 116 and fourth connector 118 have similar pins and channels for alignment. Of course, the male and female components of the connectors, as well as the pins and channels, can be located in the opposite connectors (e.g., first connector 110 having female receptors and alignment channels and second connector 112 having male pins and alignment pins).

As seen in FIG. 1*a*, the present invention allows first planar board 108 to move both laterally and transversely until first connector 110 and second connector 112 are mated. Thus, as shown in FIG. 1*b*, when alignment pins 130 and alignment channels 132 are mated, and first connector male pins 122 are mated with second connector female receptor 120, lateral and transverse movement first planar board 108 relative to second planar board 114 is stopped. Until these two connectors actually mate, however, first planar board 108 is free to move transversely up to the limits of an angular constraint pin hole 210 (shown in FIG. 2) and to move longitudinally according to the compression limit of a spring clip 212 (also shown in FIG. 2 et seq.).

Returning again to FIG. 1*a*, first planar board 108 is able to rotate about a pivot pin 102, which is inserted through a pivot pin hole 204. This pivot motion allows first planar board 108 to be transversely (horizontally) positioned to a desired orientation, including an orientation that aligns first connector 110 with second connector 112.

Figure 2:
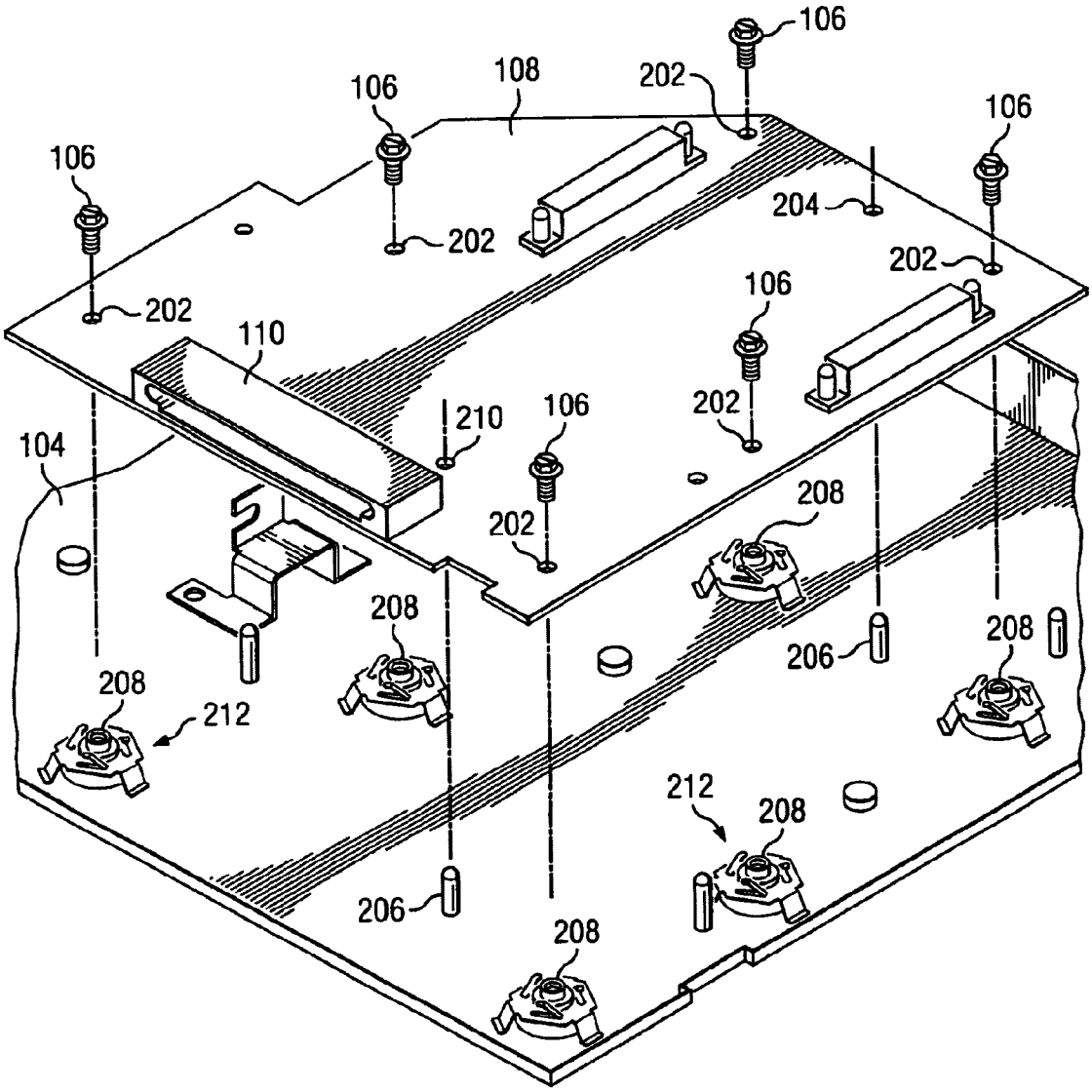
FIG. 2 depicts an exploded view of the first planar board and the first mechanical plate.

With reference now to FIG. 2, additional detail of first planar board 108 and first mechanical plate 104 are provided in an exploded view. First planar board 108 mounts to first mechanical plate 104 using mounting pins 208. In a preferred embodiment, mounting pins 208 are shoulder mounting pins, that with a spring clip 212 afford electrical communication between annular contacts (not shown) on first planar board 108 and first mechanical plate 104. First planar board 108 is further mounted to first mechanical plate 104 through the use of stationary pins 206, mounted on first mechanical plate 104, which fit through mounting holes 202 in first planar board 108. Mounting holes 202 are oversized, in order to accommodate pivoting movement of first planar board 108 about pivot pin 102. One of the stationary pins 206 also fits into an angular constraint pin hole 210, which is preferably oblong shaped in an orientation that permits several degrees of rotation about pivot pin 102. That is, angular constraint pin hole 210 has a length that permits first planar board 108 to rotate about pivot pin 102 until the stationary pin 206 reaches an end of angular constraint pin hole 210.

Oriented about each mounting pin 208 is an Electromagnetic Compatible (EMC) spring clip 212. Spring clip 212 provides an electrical contact between first planar board 108 and first mechanical plate 104, and also provides a friction fit between first planar board 108 and mechanical plate 104 as described below.

Figure 3A:
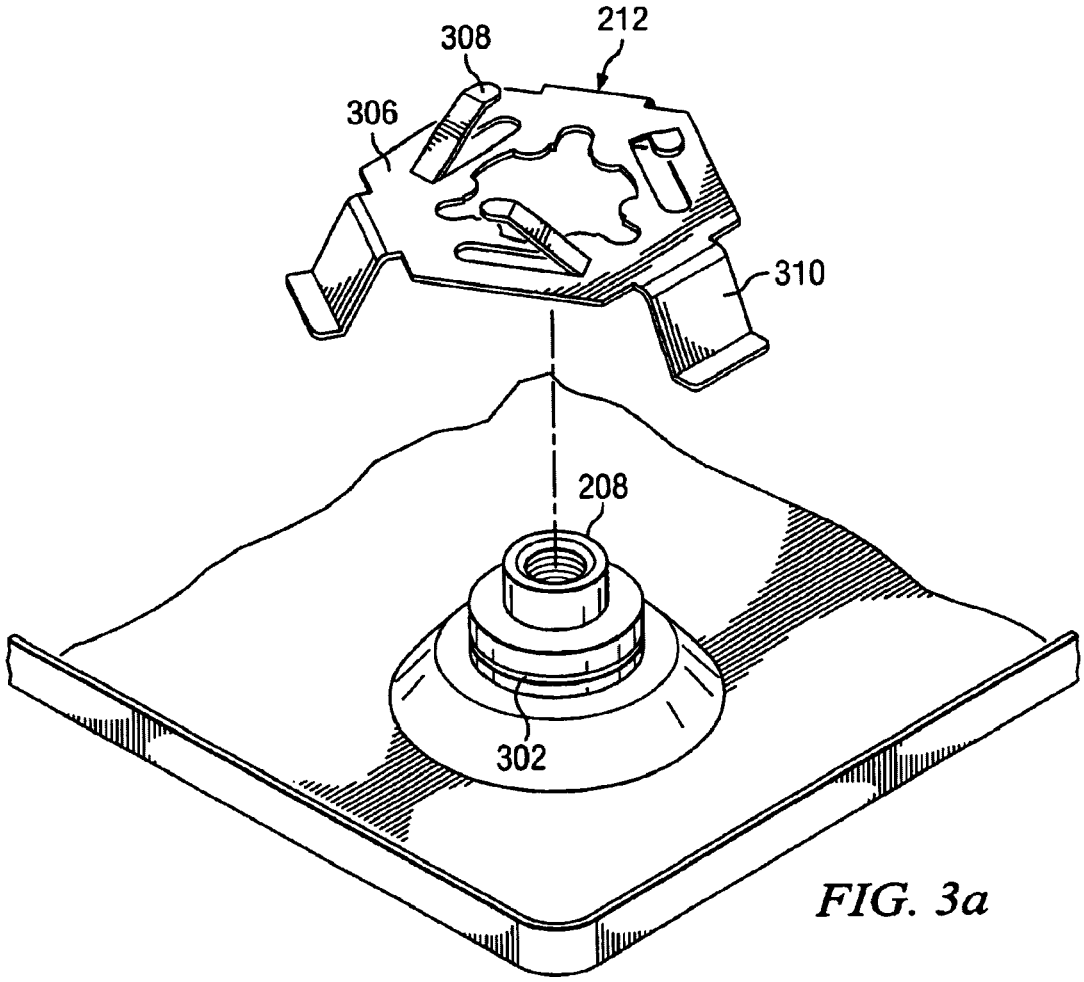
FIGS. 3*a–b* illustrate detail of a spring clip and its orientation about a mounting pin that provide a friction fit between the first planar board and the first mechanical plate.
Figure 3B:
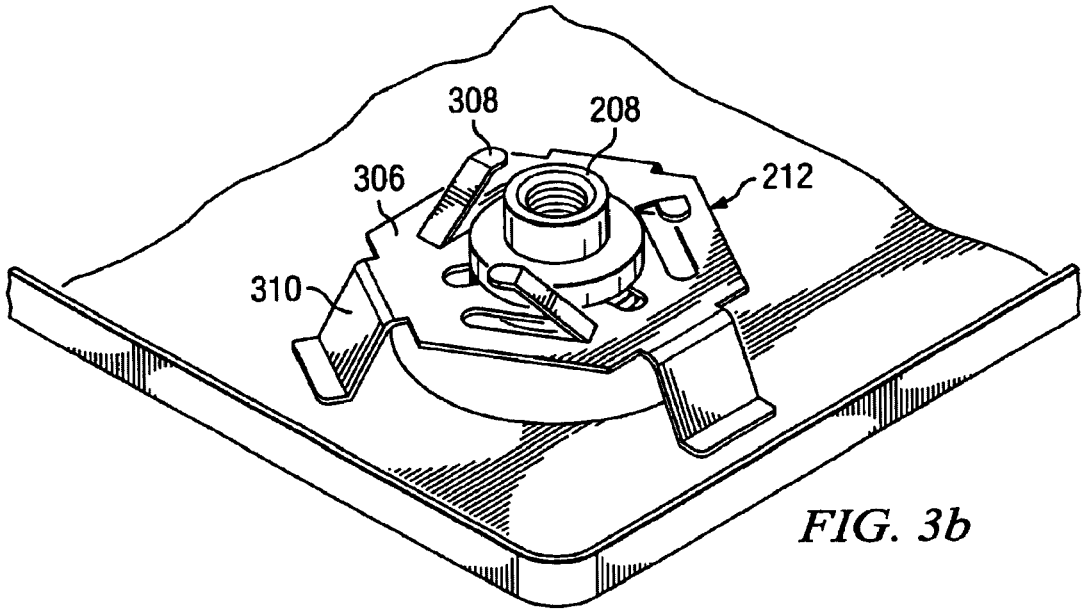

With reference now to FIGS. 3*a–b*, additional detail is given of spring clip 212 and its orientation about a mounting pin 208. As shown in FIG. 3*a*, mounting pin 208 has a lip groove 302. Spring clip 212 has a plurality of lower spring legs 310, springs 306 between the lower spring legs 310, and an upper spring leg 308 coming off each spring 306, preferably from a punched out portion of the spring 306. When spring clip 212 is properly seated about mounting pin 208, as shown in FIG. 3*b*, the springs 306 snap into the lip groove 302 of the mounting pin 208. This orientation of the spring clip 212 in the lip groove 302 prevents any movement of spring clip 212 except for compression, which causes the upper spring legs 308 to compress downward and the lower spring legs 310 to uniformly splay outward. This uniform movement thus minimizes any transverse movement of first planar board 108 when tension is applied to spring clip 212 by fastener 106.

Figure 4A:
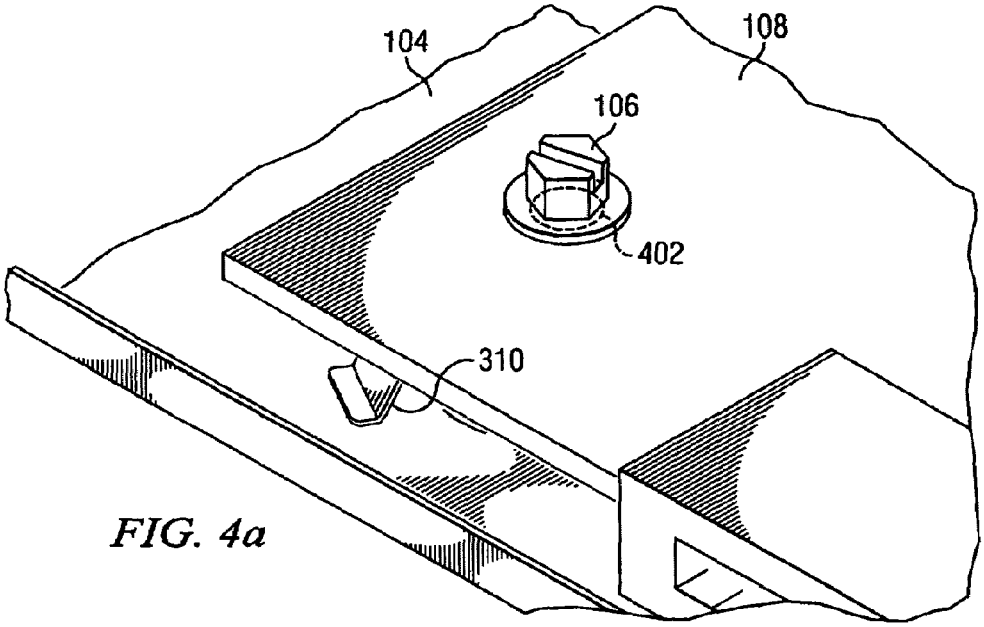
FIGS. 4*a–b* depict the first planar board and first mechanical plate mated using the spring clip and mounting pin to provide a friction fit.
Figure 4B:
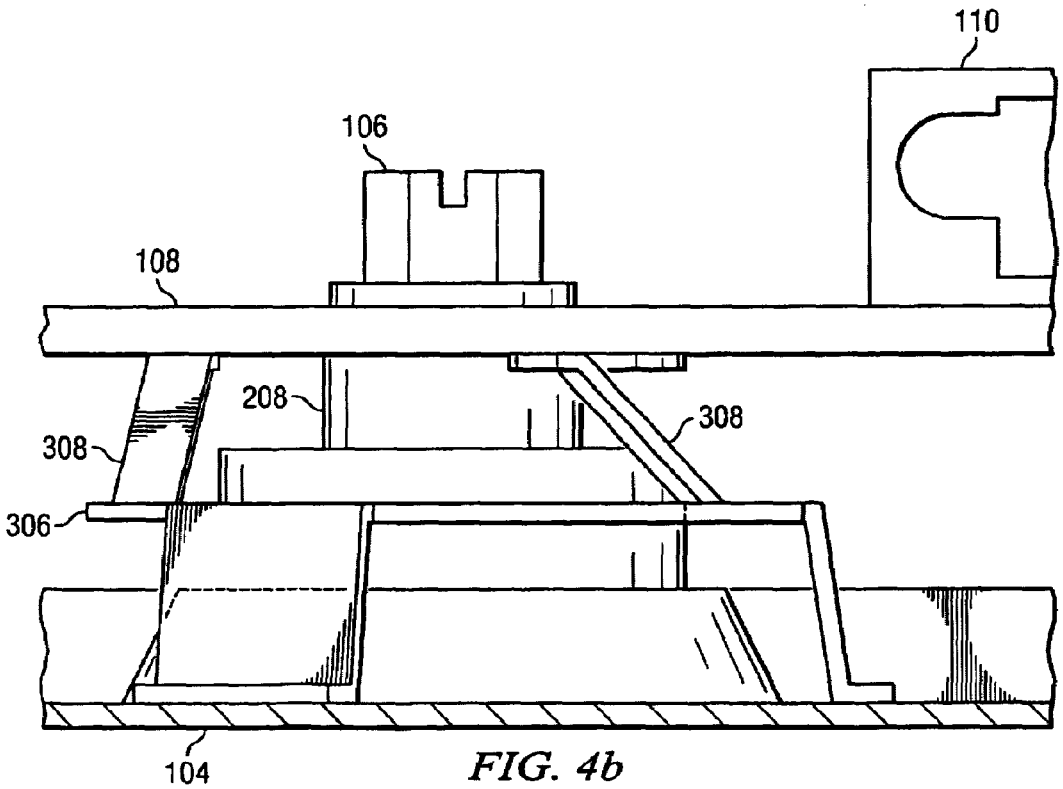

Referring now to FIGS. 4*a–b*, fastener 106 is shown coupled to the top of one of the mounting pins 208. Fastener 106 may attach to threads (not shown) on the top of mounting pin 208, or fastener 106 may attach to mounting pin 208 by pressure fitting, or fastener 106 may attach to mounting pin 208 by any other attachment means known to those skilled in the art of connectors, including adhesives, pins, clips, et al. Fastener 106 performs the function of keeping first planar board 108 oriented about mounting pin 208, but does not apply downward pressure against first planar board 108 to the extent that spring clip 212 is compressed.

Note that in FIG. 4*a*, there is a gap 402 between the bottom of fastener 106 and the surface of first planar board 108. This gap indicates that there is downward pressure on first planar board 108, resulting in the compression of spring clip 212, located below first planar board 108. The downward pressure against first planar board 108 has been mechanically or manually applied in order to mate first connector 110 with second connector 112, as shown in FIG. 1*b*.

With reference now to FIG. 4*b*, a side view is given showing spring 306 in a compressed position, caused by pressing down on first planar board 108. As force is applied downward on first planar board 108, lower spring legs 308 splay uniformly outward, thus causing a minimum, if any, of transverse travel in first planar board 108.

Thus, in a preferred embodiment of the present invention, first planar board 108 is manipulated transversely (horizontally) by pivoting about pivot pin 102, as shown in FIG. 1*a*. The "play" in spring clips 212 allows first planar board 108 to move in both the transverse and longitudinal directions. Still, the friction fit of spring clips 212 pressing against the bottom of first planar board 108 keeps first planar board 108 transversely aligned at the position to which first planar board 108 is last manipulated.

The present invention has been described in relation to particular embodiments that are intended in all respects to be illustrative rather than restrictive. Alternative embodiments will become apparent to those skilled in the art to which the present invention pertains without departing from its spirit and scope. For example, although the present invention has been described in accordance with use in attaching components inside a computer, it will be appreciated that the system may be useful in any scenario in which an adjustable alignment system is desired. Accordingly, the scope of the present invention is defined by the appended claims rather than the foregoing discussion.

PARTS LIST

102 pivot pin
104 first mechanical plate
106 fastener
108 first planar board
110 first connector
112 second connector
114 second planar board
116 third connector
118 fourth connector
120 second connector female receptor
122 first connector male pins
124 second mechanical plate
126 third planar board
128 fourth planar board
130 alignment pin
132 alignment channel
202 mounting holes
204 pivot pin hole
206 stationary pins
208 mounting pins
210 angular constraint pin hole
212 spring clip
302 lip groove
306 spring
308 upper spring leg
310 lower spring leg
402 gap

What is claimed is:

1. A board connector adjusting system comprising:

a pivot pin coupled to a mechanical plate;

a mounting pin coupled to the mechanical plate;

a fastener coupled to the mounting pin, the fastener being oriented on a first side of a first planar board; and a spring clip oriented about the mounting pin, the spring clip oriented on a second side of the first planar board, the spring clip having:

a plurality of lower spring legs, a spring connecting two of the lower spring legs, and an upper spring leg connected to the spring, wherein, the pivot pin is capable of providing a pivot point for the first planar board, the pivot pin allowing the first planar board to pivotally rotate about the pivot point, and wherein the spring clip provides a friction fit between the first planar board and the mechanical plate.

2. The board connector adjusting system of claim 1, further comprising:

a rotation limiting pin coupled to the mechanical plate, the rotation limiting pin oriented in a rotation limiting opening in the first planar board, wherein rotation of the first planar board stops when the rotation limiting pin reaches an end of the rotation limiting opening.

3. The board connector adjusting system of claim 1, wherein the spring clip is electrically conductive.

4. The board connector adjusting system of claim 4, wherein the spring clip provides electrical communication between the first plan board and the mechanical plate.

5. The board connector adjusting system of claim 1, wherein the fist planar board has a first mounted connector on an edge of the first planar board, and wherein pivotally rotating the first planar board aligns the fist mounted connector with a second mounted connector, the second mounted connector being mounted on a second planar board that is adjacent to the mechanical plate.

6. The board connector adjustment system of claim 5, wherein connecting the first mounted connector to the second mounted connector provides a rigid connection between the first and second planar boards.

7. The board connector adjustment system of claim 1, wherein the mounting pin includes a lip groove, the lip groove mating with the spring clip to provide a coupling between the mounting pin and the spring clip.

8. The board connector adjustment system of claim 1, wherein the plurality of lower spring legs are equally spaced radially about the mounting pin, wherein the tightening of the fastener causes a uniform compression of the spring clip to prevent a movement of the first planar board as pressure is applied against the first planar board.

* * * * *

UNITED STATES PATENT AND TRADEMARK OFFICE

CERTIFICATE OF CORRECTION

PATENT NO. : 7,052,291 B2
APPLICATION NO. : 10/730970
DATED : May 30, 2006
INVENTOR(S) : Barina et al.

It is certified that error appears in the above-identified patent and that said Letters Patent is hereby corrected as shown below:

Column 6, line 20, delete “plan” and insert --planar--.

Signed and Sealed this

Twelfth Day of December, 2006

JON W. DUDAS
*Director of the United States Patent and Trademark Office*